US008696368B2

(12) United States Patent
Quezada

(10) Patent No.: US 8,696,368 B2
(45) Date of Patent: Apr. 15, 2014

(54) WALL MOUNTABLE UNIVERSAL SERIAL BUS AND ALTERNATING CURRENT POWER SOURCING RECEPTACLE

(76) Inventor: Anthony Quezada, Rancho Cucamonga, CA (US)

( * ) Notice: Subject to any disclaimer, the term of this patent is extended or adjusted under 35 U.S.C. 154(b) by 0 days.

(21) Appl. No.: 13/094,747

(22) Filed: Apr. 26, 2011

(65) Prior Publication Data

US 2012/0276763 A1 Nov. 1, 2012

(51) Int. Cl.
*H01R 13/648* (2006.01)

(52) U.S. Cl.
USPC ..... 439/108

(58) Field of Classification Search
USPC ..... 439/108, 638–642, 620.01, 957, 736
See application file for complete search history.

(56) References Cited

U.S. PATENT DOCUMENTS 2,925,549 A * 2/1960 Daniel ..... 323/249
4,075,548 A * 2/1978 Leinonen ..... 323/263
7,101,226 B1 * 9/2006 Gilliland ..... 439/620.01
8,021,198 B2 * 9/2011 Lim et al. ..... 439/736
8,348,682 B1 * 1/2013 Draggie et al. ..... 439/107
2003/0030977 A1 * 2/2003 Garnett et al. ..... 361/687
2006/0292905 A1 * 12/2006 Gilliland ..... 439/107
2010/0075540 A1 * 3/2010 Liao ..... 439/638
2010/0213892 A1 * 8/2010 DeSanctis ..... 320/107

* cited by examiner

*Primary Examiner* — Jean F Duverne
(74) *Attorney, Agent, or Firm* — Patent Venture Group; Joe A. Brock, II

(57) ABSTRACT

An invention is afforded for a wall mountable universal serial bus (USB) and alternating current (AC) power sourcing receptacle. The invention includes an AC electrical receptacle that is capable of providing AC voltage of at least 120 volts. In addition, a USB electrical receptacle is included that is capable of providing a 5 volt regulated direct current (DC) voltage. At least one hot wire connection capable of facilitating carrying of a current from a source to a load, and at least one neutral wire connection capable of facilitating carrying of a current from the load to the source is included. Also included is a regulated voltage sourcing unit (RVSU) capable of transforming unregulated AC power to 5 volt regulated DC power.

15 Claims, 7 Drawing Sheets

WALL MOUNTABLE UNIVERSAL SERIAL BUS AND ALTERNATING CURRENT POWER SOURCING RECEPTACLE

BACKGROUND OF THE INVENTION

1. Field of the Invention

This invention relates generally to universal serial bus technology, and more particularly to a wall mountable power sourcing receptacle having universal serial bus and alternating current functionality.

2. Description of the Related Art

Today, many electrical devices utilize power supplied from electrical sockets. Generally the sockets accept a pair of flat blade-type prongs, each rectangular in cross section. For example, typical prongs can be 0.25 inches wide, slightly less than 1/16 inch thick, and almost 0.075 inches long. The two prongs generally are set 0.05 inch apart. Often a terminal for a third, grounding prong is provided, which usually is round in cross section, instead of rectangular.

For historical reasons, such electrical outlets are designed for use with devices that operate utilizing alternating current (AC). For example, the typical outlet is designed for use with AC devices such as vacuum cleaners, power tools, and other AC power appliances and devices.

However, as technology has increased, so has the amount of external portable devices being used by individuals. These devices generally require direct current (DC) power to operate and charge. For example, compact disc (CD) players, portable telephones, tape recorders, and computer peripheral devices, all require DC power to operate. For these devices to operate properly in conjunction with a typical prior art electrical outlet, some form of external power adapter is necessary to provide DC power from the AC electrical outlet.

Currently, many portable devices such as cellular telephones and computer peripheral devices utilize a universal serial bus (USB) based connections. Such devices typically derive power for operation and/or charging via a USB interface in the device. Today, computer peripherals such as mice, keyboards, digital cameras, printers, personal media players, flash drives, Network Adapters, and external hard drives can all be connected via a USB interface.

As mentioned above, USB devices can derive power as well as data through a USB interface. For example, USB specifications provide a 5 volt supply on a single wire from which connected USB devices may draw power. Generally the USB specification provides for no more than 5.25 V and no less than 4.75 V (5 V±5%) between the positive and negative bus power lines. As such, for many USB devices the only interface provided is a USB interface.

Unfortunately, such devices generally must be connected to a computer or external power supply to operate or derive charge. For example, a typical USB peripheral device such as a mouse generally must be either physically connected to a powered computer to operate, or have been connected to such a computer to be charged for later wireless operation. Also, a typically cellular telephone must be connected to an external "brick" power adapter in order to derive charge for later operation. Such brick power adapters often are bulky and inconvenient for individuals to carry about their person in case their devices require additional charge, such as while traveling.

In view of the forgoing, what is needed is an apparatus that allows powering of USB based devices in a manner similar to AC powered devices. Such an apparatus should be easily usable and installable and should not require special hook ups or other special configuration considerations to install. In addition, such an apparatus should allow USB based devices to easily connect to a power source without the use of bulky external power adapters.

SUMMARY OF THE INVENTION

Broadly speaking, embodiments of the present invention address these needs by providing a wall mountable universal serial bus compliant electrical receptacle. In one embodiment, a wall mountable universal serial bus (USB) and alternating current (AC) power sourcing receptacle is disclosed. The wall mountable USB and AC power sourcing receptacle includes an AC electrical receptacle that is capable of providing AC voltage of at least 120 volts. In addition, a USB electrical receptacle is included that is capable of providing a 5 volt regulated direct current (DC) voltage. To provide a means of connecting to an existing wall socket housing, at least one hot wire connection is included that is capable of facilitating carrying of a current from a source to a load, and at least one neutral wire connection is included that is capable of facilitating carrying of a current from the load to the source is included. Typically, both the hot wire connection and the neutral wire connection can be embodied as screws.

The wall mountable USB and AC power sourcing receptacle can further include a regulated voltage sourcing unit (RVSU). The RVSU is capable of transforming unregulated AC power to 5 volt regulated DC power, and is in electrical communication with the USB electrical receptacle and at least one hot wire connection. To transform the unregulated AC power to a 5 volt regulated DC power for with the USB receptacle, the RVSU can include a transformer means for transforming an AC voltage to a lower AC voltage, a rectifier means for converting an AC voltage to a DC voltage, a filter means for smoothing the DC voltage, and a voltage regulator means for maintaining a regulated DC voltage. For safety purposes, the wall mountable USB and AC power sourcing receptacle can include a ground connection. As will be described in greater detail subsequently, the wall mountable USB and AC power sourcing receptacle can include a plurality of USB electrical receptacles and a plurality of AC electrical receptacles.

As will be seen below, embodiments of the present invention advantageously allow USB devices to draw power from a wall socket without the need of external power adaptors. In addition, the design does not require any special consideration to install. Since, embodiments of the present invention can be installed in the same manner as prior art wall sockets, no special training is needed, thus allowing easy installation to anyone that can install a standard wall socket. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a wall mountable universal serial bus compliant electrical receptacle. In general, embodiments of the present invention combine an electrical receptacle having a universal serial bus compliant connector receptacle with an AC electrical receptacle. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
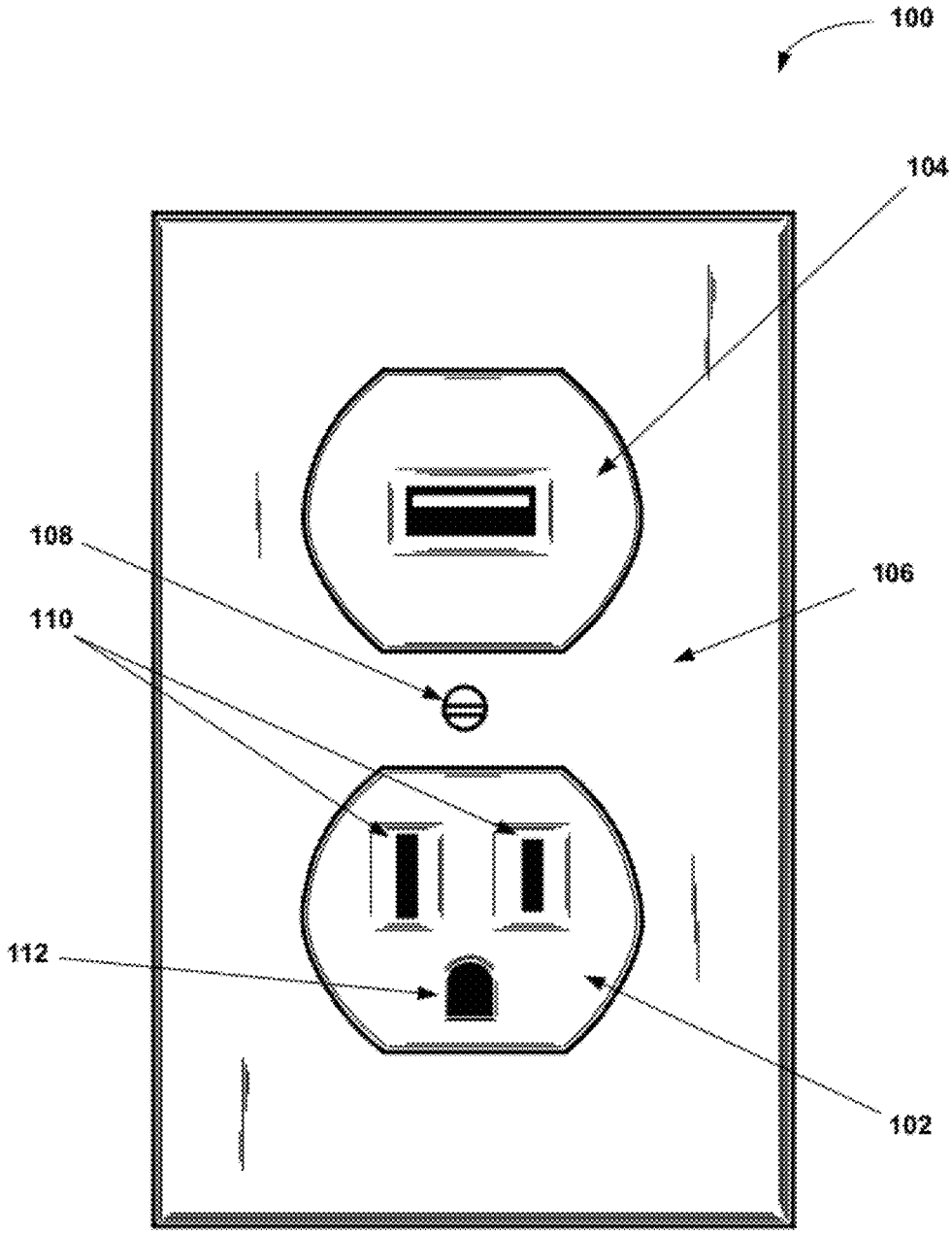
FIG. 1 is an illustration showing an exemplary wall mountable universal serial bus (USB) and alternating current (AC) power sourcing receptacle, in accordance with an embodiment of the present invention.

FIG. 1 is an illustration showing an exemplary wall mountable universal serial bus (USB) and alternating current (AC) power sourcing receptacle 100, in accordance with an embodiment of the present invention. More particularly, the exemplary wall mountable USB and AC power sourcing receptacle 100 of FIG. 1 is shown mounted on a wall ready for use. As such, the exemplary wall mountable USB and AC power sourcing receptacle 100 includes an AC electrical receptacle 102 and a USB receptacle 104. Covering the wall mountable USB electrical and AC receptacle 100 is a faceplate 106, which includes apertures providing access to the AC electrical receptacle 102 and a USB receptacle 104. Typically, the faceplate 106 can be held in place via a screw 108 or other fastener capable of mounting the faceplate 106 to the USB electrical and AC receptacle 100.

The AC electrical receptacle 102 provides female electrical connectors 110 that accept the prongs of inserted plugs and deliver current to AC powered equipment. For safety, the AC electrical receptacle 102 can include a grounded female conductor 112 commonly referred to as a ground conductor to reduce the risk of injury or death by electric shock. In general, the AC electrical receptacle 102 is capable of providing up to 15 amperes and 125 volts of electricity to plugs inserted into the AC electrical receptacle 102. Although FIG. 1 illustrates a North American 15 A/125 V (NEMA-5) grounded AC electrical receptacle 102, it should be noted that any AC electrical plug configuration can be utilized in connection with the teachings of the present invention. As will be apparent to those skilled in the art with the hindsight provided by a careful reading of the present disclosure, the type of electrical receptacle can typically be dictated by the country and national standards legislation present therein. For example, AC electrical plug configuration can be NEMA-1, JIS C 8303, Class II, CEE 7/16, CEE 7/17, BS 4573, BS 546, or any other AC electrical plug configuration capable of providing AC electricity.

The USB receptacle 104 provides 100-150 milliamps (mA) and 5 volts direct current (DC) to devices inserted into USB receptacle 104. In general, the USB receptacle 104 can connect and provide DC power to computer peripherals, digital cameras, printers, personal media players, flash drives, Network Adapters, external hard drives, and other devices capable of accepting power or charge via a USB connector. As will be described in greater detail subsequently, in one embodiment the USB receptacle 104 does not include data pins, allowing any capable USB device to be charged and/or operated from a standard USB cable. Although FIG. 1 illustrates a USB receptacle 104 capable of connecting USB 2.0 Standard-A type connectors, it should be borne in mind that any type of USB receptacle 104 can be utilized with the embodiments of the present invention. For example, the USB receptacle 104 can be compatible with a USB 2.0 Standard-B type connector, Mini-A Mini-B, Micro-A, Micro-B or any other USB compatible connector, depending on the needs of the manufacturer and/or the end user.

Figure 2:
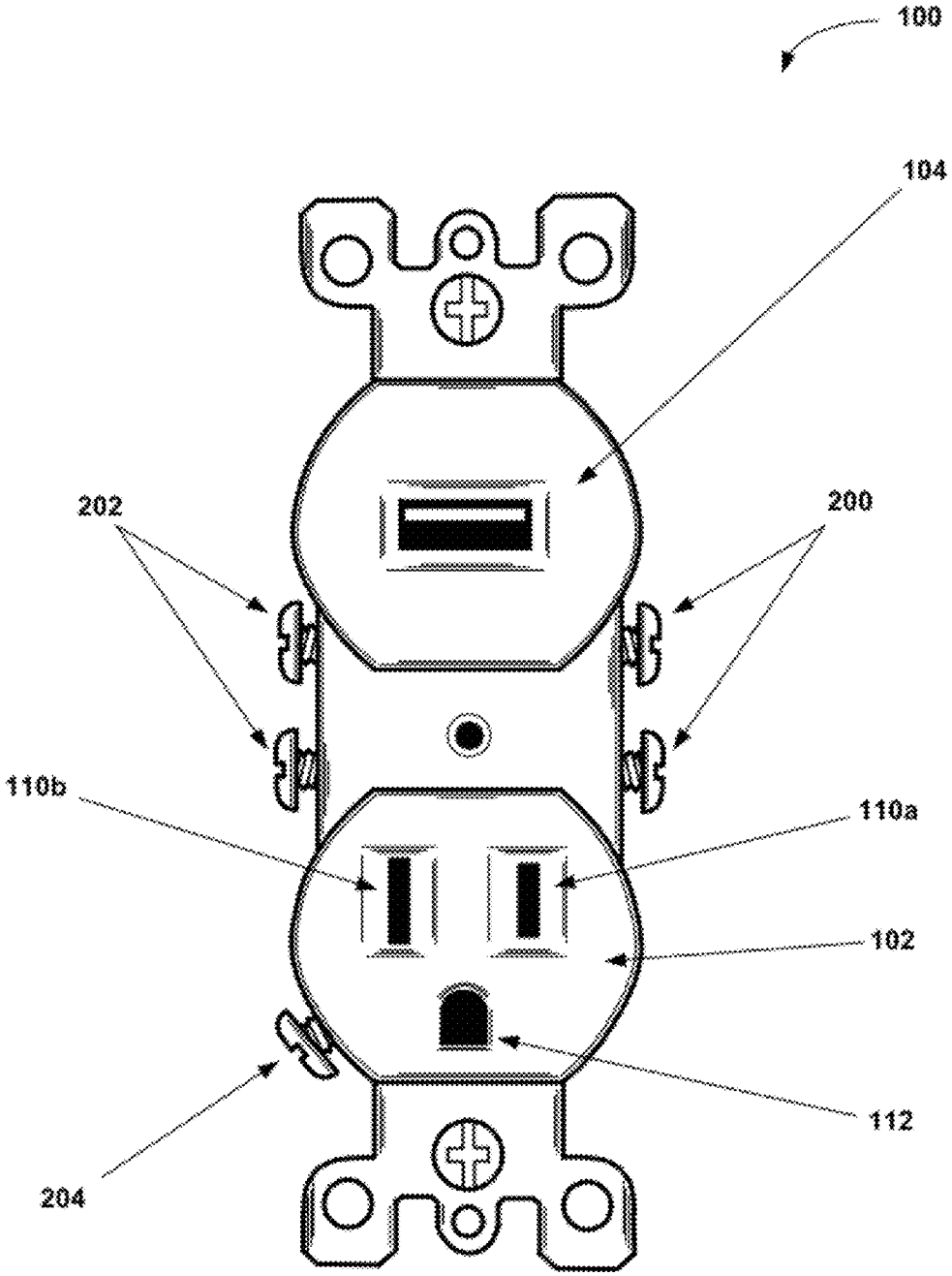
FIG. 2 is an illustration showing an exemplary wall mountable USB and AC power sourcing receptacle without the faceplate, in accordance with an embodiment of the present invention.

FIG. 2 is an illustration showing an exemplary wall mountable USB and AC power sourcing receptacle 100 without the faceplate, in accordance with an embodiment of the present invention. The wall mountable USB and AC power sourcing receptacle 100 includes an AC electrical receptacle 102 and a USB receptacle 104. As mentioned previously, the AC electrical receptacle 102 provides female electrical connectors 110*a* and 110*b* that accept the prongs of inserted plugs and deliver current to AC powered equipment. Specifically, electrical connector 110*a* is a hot connector that carries current from the source to the load. Electrical connector 110*b* is a neutral connector that returns the current to the source. The ground conductor 112 is utilized to reduce the risk of injury or death by electric shock. The USB receptacle 104 provides 100-150 mA and 5 volts DC to devices inserted into USB receptacle 104. The USB receptacle 104 can connect and provide DC power to computer peripherals, digital cameras, printers, personal media players, flash drives, Network Adapters, external hard drives, and other devices capable of accepting power or charge via a USB connector.

The wall mountable USB and AC power sourcing receptacle 100 further includes a plurality of hot wire connections 200, typically embodied as screws. In addition, a plurality of neutral wire connections 202, also typically embodied as screws, is disposed opposite the hot wire connections 200. The USB and AC power sourcing receptacle 100 further includes a ground connection 204, also typically embodied as a screw. In use, the hot wire connections 200 are connected to the hot wires on the primary electrical power supply wires connected to the main fuses or circuit breakers serving a building. Similarly, the neutral wire connections 202 are connected to the neutral wires on the primary electrical power supply wires, and the ground connection 204 is connected to the ground wire.

The position of the wall mountable USB and AC power sourcing receptacle 100 in the main electrical power supply circuit determines the number of connections needed. More specifically, when the wall mountable USB and AC power sourcing receptacle 100 is the last electrical receptacle in the circuit, only one set of wires generally is connected to USB and AC power sourcing receptacle 100. In this case, one hot wire connection 200 is connected to one hot wire on the primary electrical power supply wires and one neutral wire connection 202 is connected to one neutral wire on the primary electrical power supply wires. The ground connection 204 is connected to the ground wire.

When the wall mountable USB and AC power sourcing receptacle 100 is not the last electrical receptacle in the circuit, two sets of wires generally is connected to USB and AC power sourcing receptacle 100. Here, one hot wire connection 200 is connected to one hot wire on the primary electrical power supply wires and one neutral wire connection 202 is connected to one neutral wire on the primary electrical power supply wires. In addition, another set of wires carries power to other electrical receptacles further down the circuit. That is, the other hot wire connection 200 is connected to another hot wire on the primary electrical power supply wires and the other neutral wire connection 202 is connected to another neutral wire on the primary electrical power supply wires that carry power to other electrical receptacles further down the circuit. Similar to above, the ground connection 204 is connected to the ground wire. Because some devices may require more power during operation than is available via a single USB receptacle, embodiments of the present invention can incorporate multiple USB receptacles, as illustrated next with reference to FIG. 3.

Figure 3:
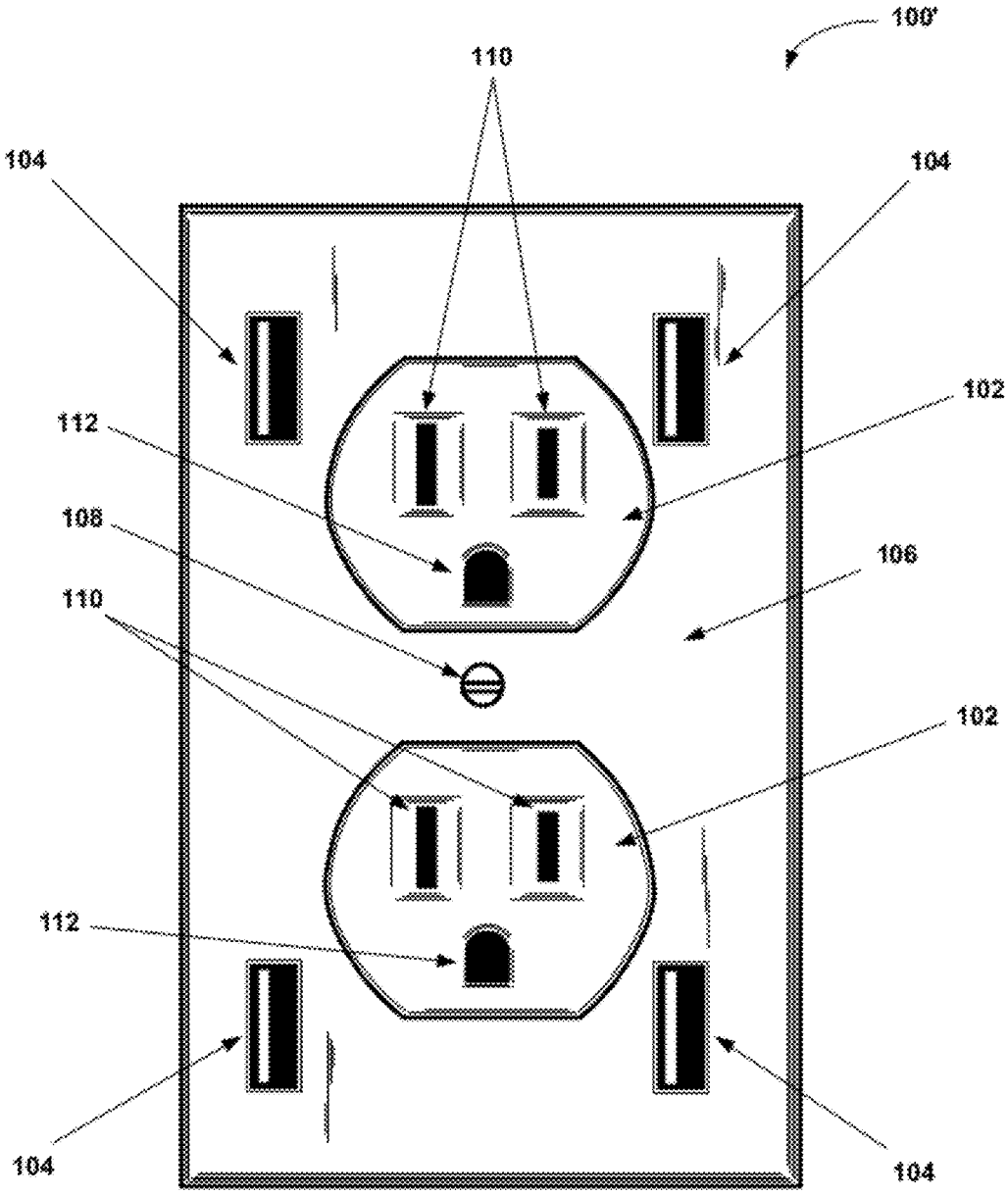
FIG. 3 is an illustration showing an exemplary wall mountable USB and alternating AC power sourcing receptacle having plurality USB receptacles, in accordance with an embodiment of the present invention.

FIG. 3 is an illustration showing an exemplary wall mountable USB and alternating AC power sourcing receptacle 100' having plurality USB receptacles 104, in accordance with an embodiment of the present invention. Similar to FIG. 1, the exemplary wall mountable USB power sourcing receptacle 100' of FIG. 3 is shown mounted on a wall ready for use. As such, the exemplary wall mountable USB and AC power sourcing receptacle 100' includes two AC electrical receptacles 102 and a plurality of USB receptacles 104. Covering the wall mountable USB electrical and AC receptacle 100' is a faceplate 106, which includes apertures providing access to the AC electrical receptacles 102 and each USB receptacle 104. Typically, the faceplate 106 can be held in place via a screw 108 or other fastener capable of mounting the faceplate 106 to the USB electrical and AC receptacle 100'.

As mentioned previously, each AC electrical receptacle 102 provides female electrical connectors 110 that accept the prongs of inserted plugs and deliver current to AC powered equipment. For safety, the AC electrical receptacle 102 can include a grounded female conductor 112 commonly referred to as a ground conductor to reduce the risk of injury or death by electric shock. In general, the AC electrical receptacle 102 is capable of providing up to 15 amperes and 125 volts of electricity to plugs inserted into the AC electrical receptacle 102. Although FIG. 3 illustrates a North American 15 A/125 V (NEMA-5) grounded AC electrical receptacle 102, it should be noted that any AC electrical plug configuration can be utilized in connection with the teachings of the present invention. As will be apparent to those skilled in the art with the hindsight provided by a careful reading of the present disclosure, the type of electrical receptacle can typically be dictated by the country and national standards legislation present therein. For example, AC electrical plug configuration can be NEMA-1, JIS C 8303, Class II, CEE 7/16, CEE 7/17, BS 4573, BS 546, or any other AC electrical plug configuration capable of providing AC electricity.

Each USB receptacle 104 provides 100-150 mA and 5 volts DC to devices inserted into each USB receptacle 104. In general, each USB receptacle 104 can connect and provide DC power to computer peripherals, digital cameras, printers, personal media players, flash drives, Network Adapters, external hard drives, and other devices capable of accepting power or charge via a USB connector. As mentioned previously, in one embodiment the USB receptacles 104 do not include a host device and data pins, allowing any capable USB device to be charged and/or operated from a standard USB cable. Although FIG. 3 illustrates USB receptacles 104 capable of connecting USB 2.0 Standard-A type connectors, it should be borne in mind that any type of USB receptacle 104 can be utilized with the embodiments of the present invention. For example, the USB receptacles 104 can be compatible with a USB 2.0 Standard-B type connector, Mini-A Mini-B, Micro-A, Micro-B or any other USB compatible connector, depending on the needs of the manufacturer and/or the end user.

Figure 4:
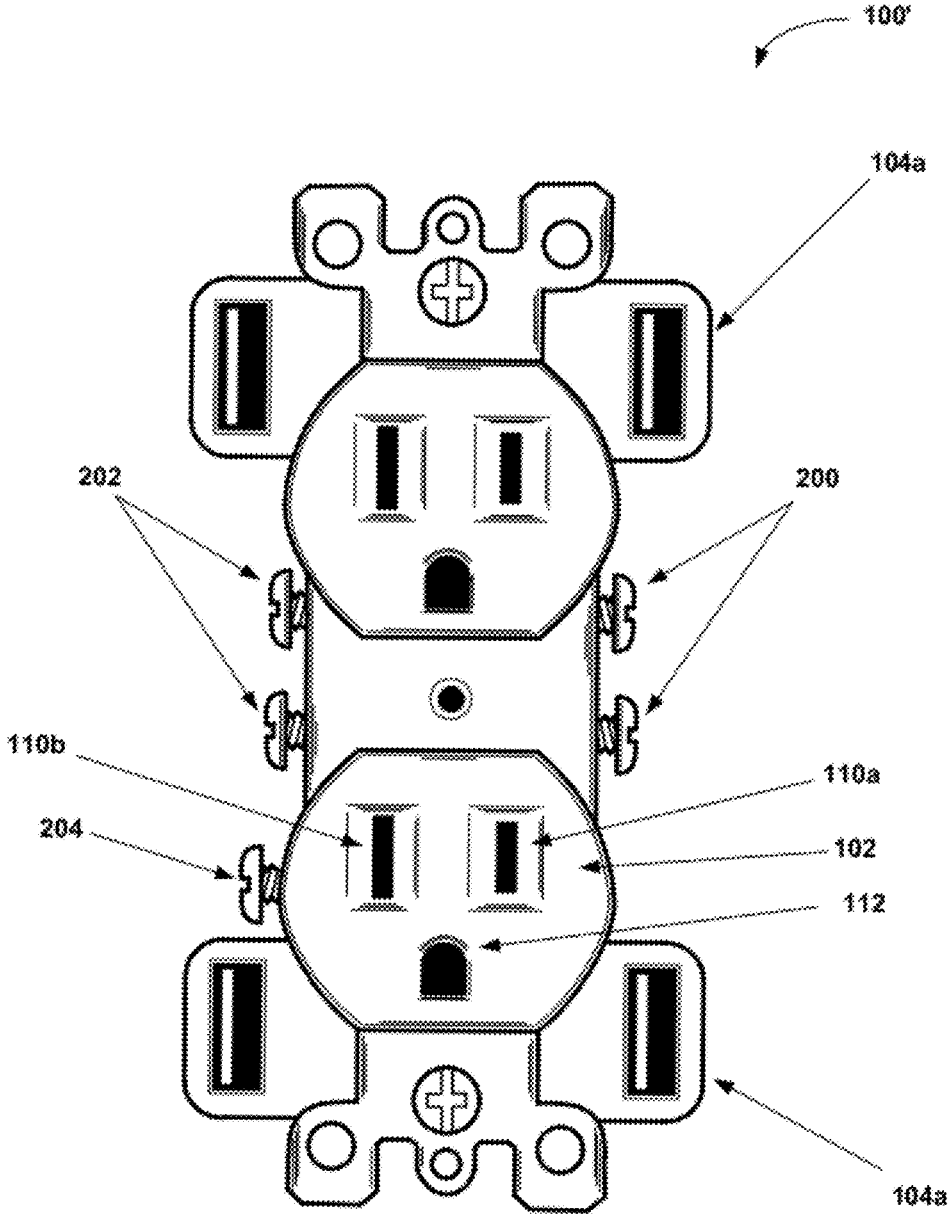
FIG. 4 is an illustration showing an exemplary wall mountable USB and AC power sourcing receptacle without the faceplate having a plurality of USB receptacles, in accordance with an embodiment of the present invention.

FIG. 4 is an illustration showing an exemplary wall mountable USB and AC power sourcing receptacle 100' without the faceplate having a plurality of USB receptacles 104, in accordance with an embodiment of the present invention. The wall mountable USB and AC power sourcing receptacle 100' includes two AC electrical receptacles 102 and a plurality USB receptacle 104. As mentioned previously, each AC electrical receptacle 102 provides female electrical connectors 110*a* and 110*b* that accept the prongs of inserted plugs and deliver current to AC powered equipment. Specifically, electrical connector 110*a* is a hot connector that carries current from the source to the load. Electrical connector 110*b* is a neutral connector that returns the current to the source. The ground conductor 112 is utilized to reduce the risk of injury or death by electric shock. Each USB receptacle 104 provides 100-150 mA and 5 volts DC to devices inserted into USB receptacle 104. The USB receptacle 104 can connect and provide DC power to computer peripherals, digital cameras, printers, personal media players, flash drives, Network Adapters, external hard drives, and other devices capable of accepting power or charge via a USB connector.

The wall mountable USB and AC power sourcing receptacle 100' further includes a plurality of hot wire connections 200, typically embodied as screws. In addition, a plurality of neutral wire connections 202, also typically embodied as screws, is disposed opposite the hot wire connections 200. The USB and AC power sourcing receptacle 100' further includes a ground connection 204, also typically embodied as a screw. In use, the hot wire connections 200 are connected to the hot wires on the primary electrical power supply wires connected to the main fuses or circuit breakers serving a building. Similarly, the neutral wire connections 202 are connected to the neutral wires on the primary electrical power supply wires, and the ground connection 204 is connected to the ground wire.

The position of the wall mountable USB and AC power sourcing receptacle 100' in the main electrical power supply circuit determines the number of connections needed. More specifically, when the wall mountable USB and AC power sourcing receptacle 100' is the last electrical receptacle in the circuit, only one set of wires generally is connected to USB and AC power sourcing receptacle 100'. In this case, one hot wire connection 200 is connected to one hot wire on the primary electrical power supply wires and one neutral wire connection 202 is connected to one neutral wire on the primary electrical power supply wires. The ground connection 204 is connected to the ground wire.

When the wall mountable USB and AC power sourcing receptacle 100' is not the last electrical receptacle in the circuit, two sets of wires generally is connected to USB and AC power sourcing receptacle 100'. Here, one hot wire connection 200 is connected to one hot wire on the primary electrical power supply wires and one neutral wire connection 202 is connected to one neutral wire on the primary electrical power supply wires. In addition, another set of wires carries power to other electrical receptacles further down the circuit. That is, the other hot wire connection 200 is connected to another hot wire on the primary electrical power supply wires and the other neutral wire connection 202 is connected to another neutral wire on the primary electrical power supply wires that carry power to other electrical receptacles further down the circuit. Similar to above, the ground connection 204 is connected to the ground wire.

As mentioned above, embodiments of the present invention, provide power via both an AC electrical receptacle and a USB receptacle. In one embodiment, the USB receptacle is designed to provide power without providing data to connected USB devices. In this embodiment, the USB receptacle generally is utilized to charge or run the USB device without providing any data connection. In order to prevent unwanted noise on the data lines, embodiments of the present invention can remove any connection to the data terminals, as illustrated next with reference to FIG. 5.

Figure 5:
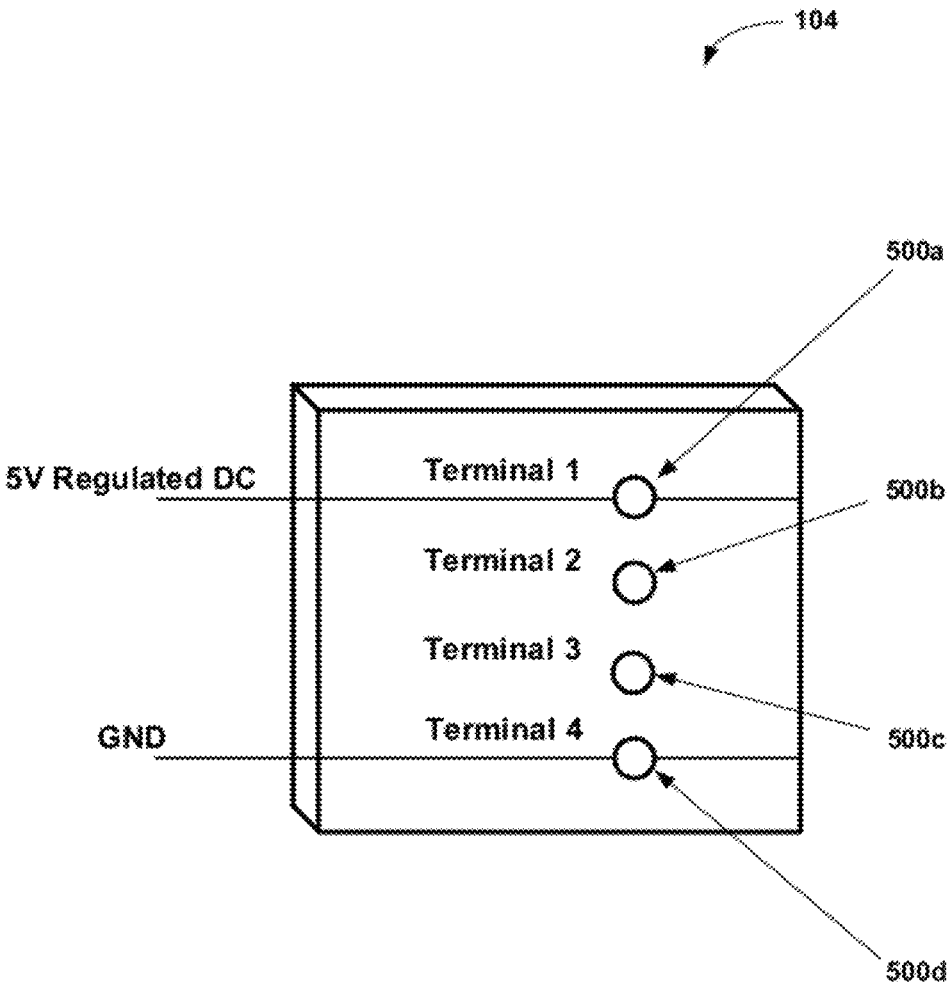
FIG. 5 is a block diagram showing an exemplary USB receptacle utilized in connection with the wall mountable USB and AC electrical receptacle of the embodiments of the present invention.

FIG. 5 is a block diagram showing an exemplary USB receptacle 104 utilized in connection with the wall mountable USB and AC electrical receptacle of the embodiments of the present invention. As illustrated in FIG. 5, the exemplary USB receptacle 104 can include four terminals 500*a*-500*d*. Terminal 1 500*a* provides power to connected USB devices and is connected to a 5 volt regulated DC source, described in greater detail subsequently. Terminals 2 and 3 500*b*-500*c* normally provide data connections in conventional USB connections. However, to avoid unwanted noise on the data lines, embodiments of the present invention can either omit terminals 2 and 3 500*b*-500*c* or provide the terminals not connected to any other wires. Terminal 4 500*d* provides a connection to ground. In this manner, embodiments of the present invention can provide power directly to USB devices without the risk of unwanted noise on the data lines, thus avoiding unwanted data corruption or false reads in connected USB devices.

Figure 6:
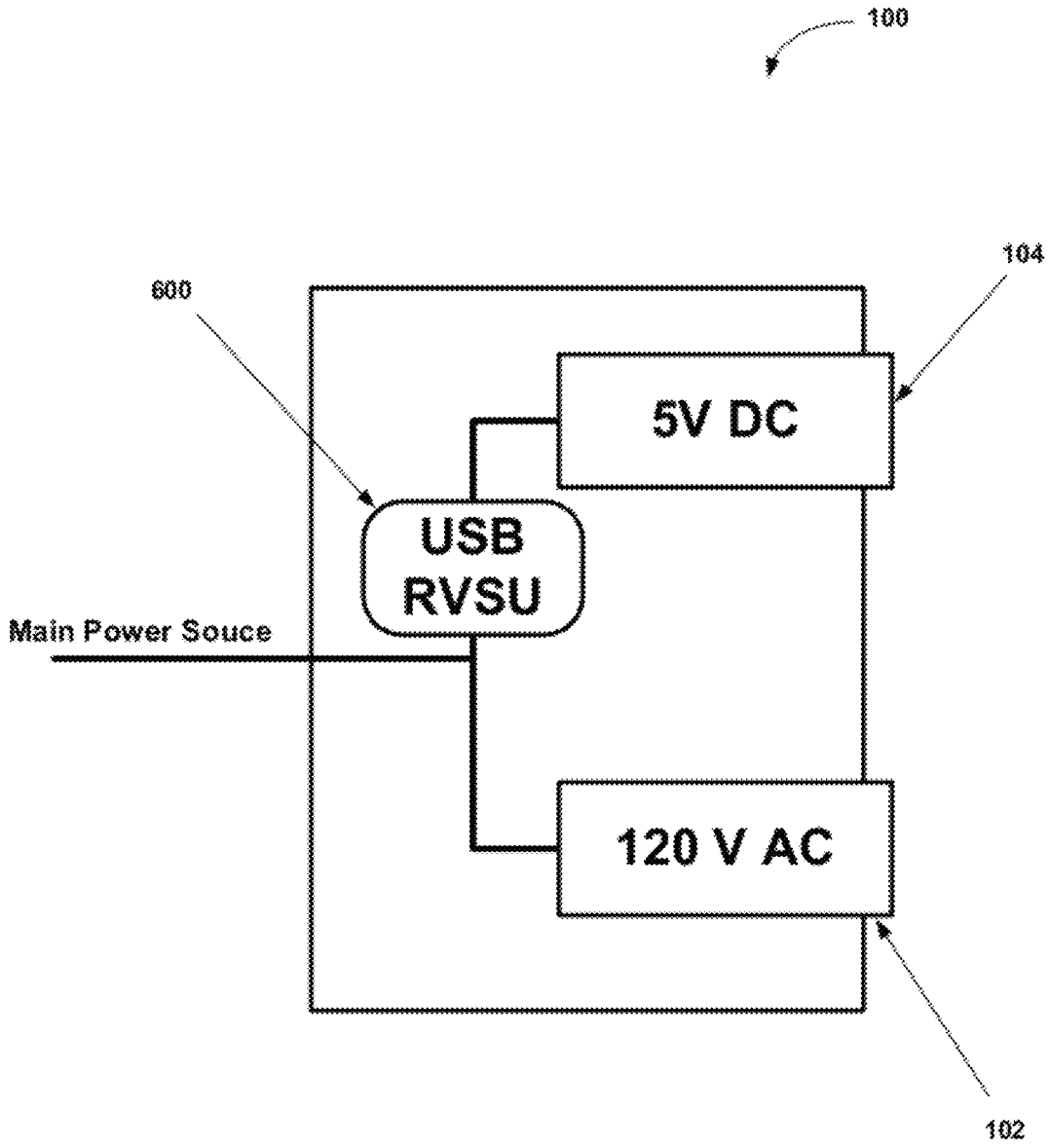
FIG. 6 is a block diagram showing an exemplary wall mountable USB and AC power sourcing receptacle, in accordance with an embodiment of the present invention.

FIG. 6 is a block diagram showing an exemplary wall mountable USB and AC power sourcing receptacle 100, in accordance with an embodiment of the present invention. The block diagram of FIG. 6 illustrates generally the flow of power to the receptacles of the wall mountable USB and AC power sourcing receptacle 100 of the embodiments of the present invention. Generally, embodiments of the present invention receive power from a main power source. Received power then is directed to one or more AC electrical receptacles 102, each capable of providing up to 15 amperes and 125 volts of electricity to plugs inserted into the AC electrical receptacle 102. Similar to above, although FIG. 6 illustrates a North American 15 A/125 V (NEMA-5) grounded AC electrical receptacle 102, it should be noted that any AC electrical plug configuration can be utilized in connection with the teachings of the present invention. As will be apparent to those skilled in the art with the hindsight provided by a careful reading of the present disclosure, the type of electrical receptacle can typically be dictated by the country and national standards legislation present therein. For example, AC electrical plug configuration can be NEMA-1, JIS C 8303, Class II, CEE 7/16, CEE 7/17, BS 4573, BS 546, or any other AC electrical plug configuration capable of providing AC electricity.

In addition, received power also is provided to a USB regulated voltage sourcing unit (RVSU) 600, which provides a 5 volt regulated DC source to one or more USB electrical receptacles 104. Similar to above, although FIG. 6 a illustrates USB receptacle 104 capable of connecting USB 2.0 Standard-A type connectors, it should be borne in mind that any type of USB receptacle 104 can be utilized with the embodiments of the present invention. For example, the USB receptacles 104 can be compatible with a USB 2.0 Standard-B type connector, Mini-A Mini-B, Micro-A, Micro-B or any other USB compatible connector, depending on the needs of the manufacturer and/or the end user. To provide the appropriate current and voltage to the USB electrical receptacle 104, the USB RVSU 600, inter alia, reduces the AC voltage and converts it to DC as illustrated next with reference to FIG. 7.

Figure 7:
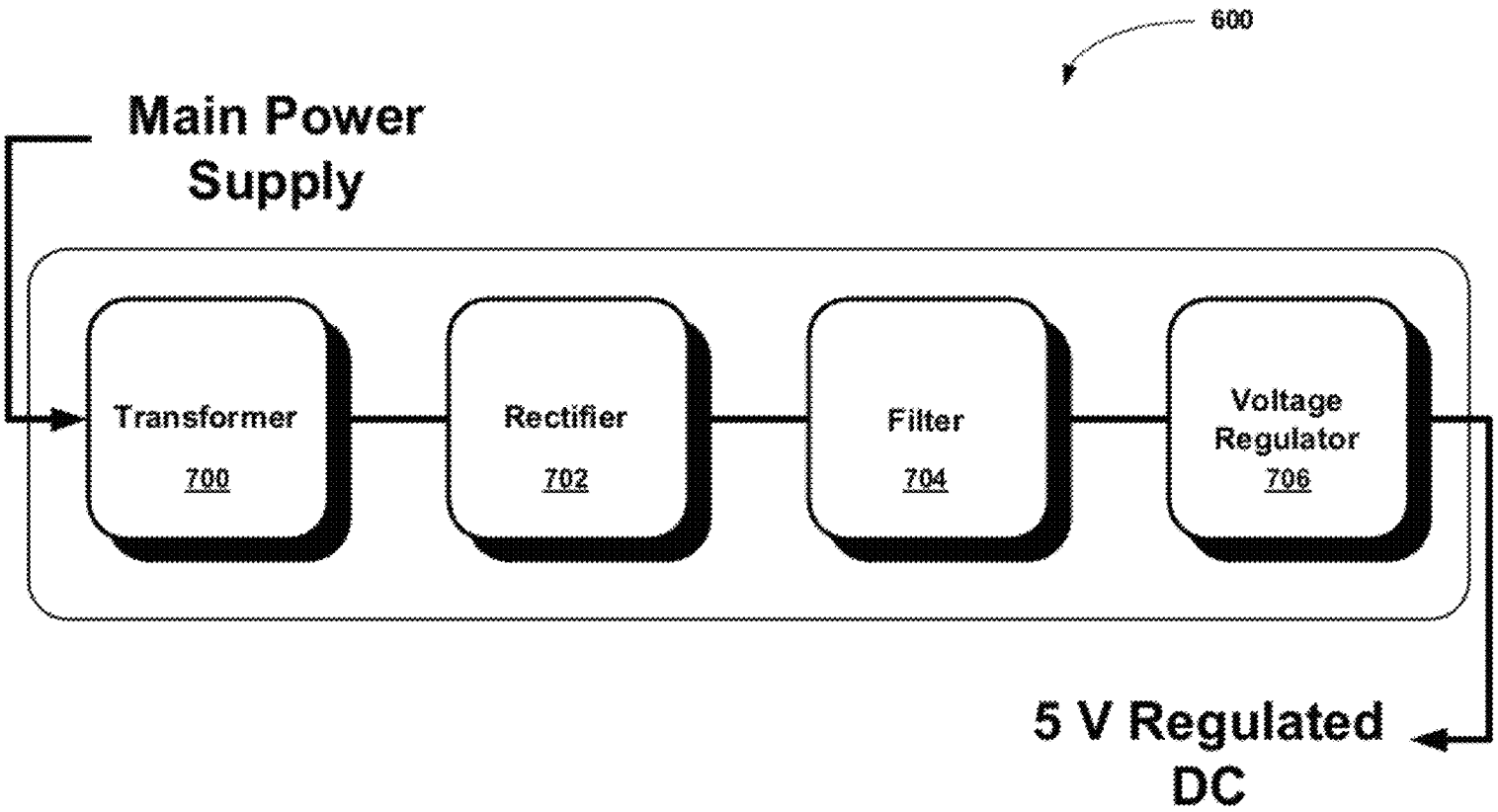
FIG. 7 is a block diagram showing a USB RVSU, in accordance with an embodiment of the present invention.

FIG. 7 is a block diagram showing a USB RVSU 600, in accordance with an embodiment of the present invention. In one embodiment, the USB RVSU 600 includes a transformer means 700, rectifier means 702, filter means 704, and a voltage regulating means 706. In general, the transformer means 700 functions to step down the incoming source voltage to a lower voltage of about 5 volts suitable for most USB devices. For example, the transformer means 700 can be a device that inductively transfers electrical energy from one circuit to another utilizing coils via mutual induction. Optionally, additional types of transforming circuits can be utilized with the embodiments of the present invention. For example, a Zener diode can be used to reduce the voltage as described above. The rectifier means 702 functions to convert the alternating voltage to a pulsating DC voltage. For example, diode configurations can be utilized as a rectifier means 702 to restrict the AC voltage to either the positive or negative half of the wave. The filter means 704 functions to smooth the pulsating wave resulting from the rectifier means 702. In general, the filter means 704 can comprise a plurality of resistors, inductors, and capacitors configured to smooth the wave form. The optional voltage regulator means 706 functions to automatically maintain the voltage at a predefined level, for example, approximately 5 volts. For example, the voltage regulator means 706 can be a shunt regulator, such as a zener diode, a resistor in series with a diode, a feedback voltage regulator, or any other means for providing voltage regulating as will be apparent to those skilled in the art with the hindsight provided by a careful reading of the present disclosure. In this manner, the USB RVSU 600 of the embodiments of the present invention provides a 5 volt regulated voltage to each USB receptacle present in the USB and AC wall mountable USB and AC power sourcing receptacle 100 of the embodiments of the present invention.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A wall mountable universal serial bus (USB) and alternating current (AC) power sourcing receptacle, comprising:

an alternating current (AC) electrical receptacle, the AC electrical receptacle providing AC voltage of at least 120 volts when the USB and AC power sourcing receptacle is in electrical communication with a source;

a universal serial bus (USB) electrical receptacle, the USB electrical receptacle providing about a 5 volt regulated direct current (DC) voltage when the USB and AC power sourcing receptacle is in electrical communication with the source;

at least one hot wire connection configured to physically connect to hot wires on a primary electrical power supply wires, wherein the hot wire connection is configured to facilitate carrying of a current from the source to a load; and at least one neutral wire connection configured to physically connect to neutral wires on the primary electrical power supply wires, wherein the neutral wire connection is configured to facilitate carrying of a current from the load to the source, wherein USB and AC power sourcing receptacle, including the AC electrical receptacle, USB electrical receptacle, hot wire connection, and neutral wire connection are configured to be covered by a single faceplate having apertures when the USB and AC power sourcing receptacle is mounted.

2. A wall mountable USB and AC power sourcing receptacle as recited in claim 1, further comprising a regulated voltage sourcing unit (RVSU), wherein the RVSU transforms unregulated AC power to about 5 volt regulated DC power.

3. A wall mountable USB and AC power sourcing receptacle as recited in claim 2, wherein the RVSU is in electrical communication with the USB electrical receptacle and at least one hot wire connection.

4. A wall mountable USB and AC power sourcing receptacle as recited in claim 2, wherein the RVSU comprises:

a transformer means for transforming an AC voltage to a lower AC voltage;

a rectifier means for converting an AC voltage to a DC voltage;

a filter means for smoothing the DC voltage; and a voltage regulator means for maintaining a regulated DC voltage.

5. A wall mountable USB and AC power sourcing receptacle as recited in claim 1, further comprising a ground connection and a single faceplate having apertures covering USB and AC power sourcing receptacle, including the AC electrical receptacle, USB electrical receptacle, hot wire connection, and neutral wire connection.

6. A wall mountable USB and AC power sourcing receptacle as recited in claim 1, wherein a plurality of USB electrical receptacles and a plurality of AC electrical receptacles are included.

7. A wall mountable universal serial bus (USB) and alternating current (AC) power sourcing receptacle, comprising:

an alternating current (AC) electrical receptacle, the AC electrical receptacle providing AC voltage of at least 120 volts when the USB and AC power sourcing receptacle is in electrical communication with a source;

a universal serial bus (USB) electrical receptacle, the USB electrical receptacle providing a 5 volt regulated direct current (DC) voltage when the USB and AC power sourcing receptacle is in electrical communication with the source;

at least one hot wire connection screw configured to physically connect to hot wires on a primary electrical power supply wires, wherein the hot wire connection is configured to facilitate carrying of a current from the source to a load;

at least one neutral wire connection screw configured to physically connect to neutral wires on the primary electrical power supply wires, wherein the neutral wire connection is configured to facilitate carrying of a current from the load to the source; and a regulated voltage sourcing unit (RVSU), the RVSU transforming unregulated AC power to about 5 volt regulated DC power when the power sourcing receptacle is in electrical communication with the source.

8. A wall mountable USB and AC power sourcing receptacle as recited in claim 7, wherein the RVSU is in electrical communication with the USB electrical receptacle and at least one hot wire connection.

9. A wall mountable USB and AC power sourcing receptacle as recited in claim 7, wherein the RVSU comprises:

a transformer means for transforming an AC voltage to a lower AC voltage;

a rectifier means for converting an AC voltage to a DC voltage;

a filter means for smoothing the DC voltage; and a voltage regulator means for maintaining a regulated DC voltage.

10. A wall mountable USB and AC power sourcing receptacle as recited in claim 8, further comprising a ground connection.

11. A wall mountable USB and AC power sourcing receptacle as recited in claim 7, wherein a plurality of USB electrical receptacles and a plurality of AC electrical receptacles are included.

12. A wall mountable universal serial bus (USB) and alternating current (AC) power sourcing receptacle, comprising:

an alternating current (AC) electrical receptacle, the AC electrical receptacle providing AC voltage of at least 120 volts when the USB and AC power sourcing receptacle is in electrical communication with a source;

a universal serial bus (USB) electrical receptacle, the USB electrical receptacle providing a 5 volt regulated direct current (DC) voltage when the USB and AC power sourcing receptacle is in electrical communication with the source;

at least one hot wire connection configured to facilitate carrying of a current from the source to a load;

at least one neutral wire connection configured to facilitate carrying of a current from the load to the source; and a regulated voltage sourcing unit (RVSU), wherein the RVSU transforms unregulated AC power to about 5 volt regulated DC power, the RVSU comprising:

a transformer means for transforming an AC voltage to a lower AC voltage;

a rectifier means for converting an AC voltage to a DC voltage;

a filter means for smoothing the DC voltage; and a voltage regulator means for maintaining a regulated DC voltage.

13. A wall mountable USB and AC power sourcing receptacle as recited in claim 12, wherein the RVSU is in electrical communication with the USB electrical receptacle and at least one hot wire connection.

14. A wall mountable USB and AC power sourcing receptacle as recited in claim 12, further comprising a ground connection.

15. A wall mountable USB and AC power sourcing receptacle as recited in claim 12, wherein a plurality of USB electrical receptacles and a plurality of AC electrical receptacles are included.

* * * * *